US008648758B2

(12) United States Patent
Johnson

(10) Patent No.: US 8,648,758 B2
(45) Date of Patent: Feb. 11, 2014

(54) WIDEBAND CAVITY-BACKED SLOT ANTENNA

(75) Inventor: Richard S. Johnson, Melissa, TX (US)

(73) Assignee: Raytheon Company, Waltham, MA (US)

( * ) Notice: Subject to any disclaimer, the term of this patent is extended or adjusted under 35 U.S.C. 154(b) by 726 days.

(21) Appl. No.: 12/776,305

(22) Filed: May 7, 2010

(65) Prior Publication Data

US 2011/0273351 A1 Nov. 10, 2011

(51) Int. Cl.
*H01Q 13/10* (2006.01)

(52) U.S. Cl.
USPC ..... 343/770; 343/767

(58) Field of Classification Search
USPC ..... 343/767, 770, 700 MS, 789
See application file for complete search history.

(56) References Cited

U.S. PATENT DOCUMENTS

| | | | | |
|---|---|---|---|---|
| 3,441,937 | A | 4/1969 | Clasby et al. | |
| 3,717,877 | A | 2/1973 | Hanninen et al. | |
| 4,132,995 | A | 1/1979 | Monser | |
| 5,068,670 | A * | 11/1991 | Maoz | 343/767 |
| 5,426,400 | A * | 6/1995 | Ho et al. | 333/26 |
| 5,489,913 | A * | 2/1996 | Raguenet et al. | 343/767 |
| 5,539,420 | A * | 7/1996 | Dusseux et al. | 343/769 |
| 6,806,839 | B2 | 10/2004 | Lo | |
| 2004/0070536 | A1 | 4/2004 | Stotler et al. | |
| 2004/0082309 | A1 * | 4/2004 | Smith | 455/344 |
| 2009/0153412 | A1 * | 6/2009 | Chiang et al. | 343/702 |
| 2011/0006953 | A1 * | 1/2011 | Chiang et al. | 343/702 |

FOREIGN PATENT DOCUMENTS

| | | |
|---|---|---|
| JP | 62-165403 | 7/1987 |
| WO | WO 01/80361 A1 | 10/2001 |

OTHER PUBLICATIONS

Rao, et al., "Octave Bandwidth Printed Bow-Tie Fed Partial Cavity Slot Antenna", IEEE Proceedings H. Microwaves, Antennas & Propagation, Institution of Electrical Engineers, vol. 147, No. 6, Dec. 8, 2000 (pp. 483-486).

Extended European Search Report for European Application No. 11164765.7, Extended European Search Report dated Sep. 14, 2011 and mailed Sep. 22, 2011 (5 pgs.).

Rao, P.H., et al. "Linearly Polarized Radial Stub Fed High Performance Wideband Slot Antenna", Electronics Letters, vol. 37, No. 7, Mar. 15, 2001, pp. 335-337.

Zhong, Shun-Shi, et al. "Wideband Slot Antenna Backed by a Ground Plane", IEEE, 1-4244-0123-2/06, 2006, pp. 2559-2562.

Pirich, Ronald, et al., "Passive Materials for Electromagnetic Interface Mitigation", IEEE, 0-7803-8930-1/05, 2005, 4 pages.

* cited by examiner

*Primary Examiner* — Hoanganh Le
(74) *Attorney, Agent, or Firm* — Christie, Parker & Hale, LLP

(57) ABSTRACT

A wideband cavity-backed slot antenna includes an enclosure having a slot, a balun located proximate the slot, a feed extending through the enclosure to the balun, and a plurality of coupled lines proximate the balun and distal to a location at which the balun is coupled to the feed.

17 Claims, 8 Drawing Sheets

WIDEBAND CAVITY-BACKED SLOT ANTENNA

BACKGROUND

Embodiments of the present invention are directed toward wideband cavity-backed slot antennas.

There is a need for conformal ultra wideband antennas for applications such as data links and electronic surveillance measures (ESM). These and other applications require moderate gain (~0 dBi) across a wide frequency band. Some applications require horizontally polarized signals in order to optimize system performance. It is also desirable to reduce or minimize the size, weight, and power consumption (SWAP) of the antenna.

In the field of microwave antennas, cavity-backed slot antennas are well known in the art. One advantage of slot antennas over dipole antennas is their relatively small size. For example, a cavity-backed slot antenna may be less than 1" thick and an array of such antennas can be mounted on or formed as part of the outer wall of a building or on an outer surface of a vehicle, whereas a dipole antenna typically must protrude from these outer surfaces. However, cavity-backed slot antennas typically provide only up to approximately 3:1 bandwidth ratio (i.e., the ratio of the maximum frequency to the minimum frequency) and in some applications, it is desirable to have a cavity-backed slot antenna with a bandwidth ratio larger than 3:1.

SUMMARY

One aspect of the present invention is directed toward a wideband cavity-backed slot antenna having a relatively small size and capable of operating over a wide range of frequencies. In some embodiments, the wideband cavity-backed slot antenna has a "V" or chevron shaped slot. In other embodiments, the wideband cavity-backed slot antenna includes a balun having coupled lines which are capacitively-coupled to the balun. In still other embodiments, the wideband cavity-backed slot antenna includes a cavity which is at least partially filled with a dielectric such as a magnetic radar absorbing material.

In one embodiment of the present invention, a cavity backed slot antenna includes: an enclosure having a slot; a balun located proximate the slot; a feed extending through the enclosure to the balun; and a plurality of coupled lines proximate the balun and distal to a location at which the balun is coupled to the feed.

The balun may be fan shaped. The plurality of coupled lines may be configured to be capacitively coupled to the balun when a low frequency signal is applied to the feed. The plurality of coupled lines may be configured to be decoupled from the balun when a high frequency signal is applied to the feed. The slot may have a chevron shape. The chevron shaped slot may have an angle of 120° at a tip of the slot. The enclosure may enclose a cavity having a chevron shape. The cavity may have an angle of 120° at a tip of the slot. The cavity-backed slot antenna may further include a dielectric material located within the enclosure. The dielectric material may be a magnetic radar absorbing material. The cavity-backed slot antenna may further include a capacitor and an inductor located in series between the feed and the balun.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figures 1A, 1B:
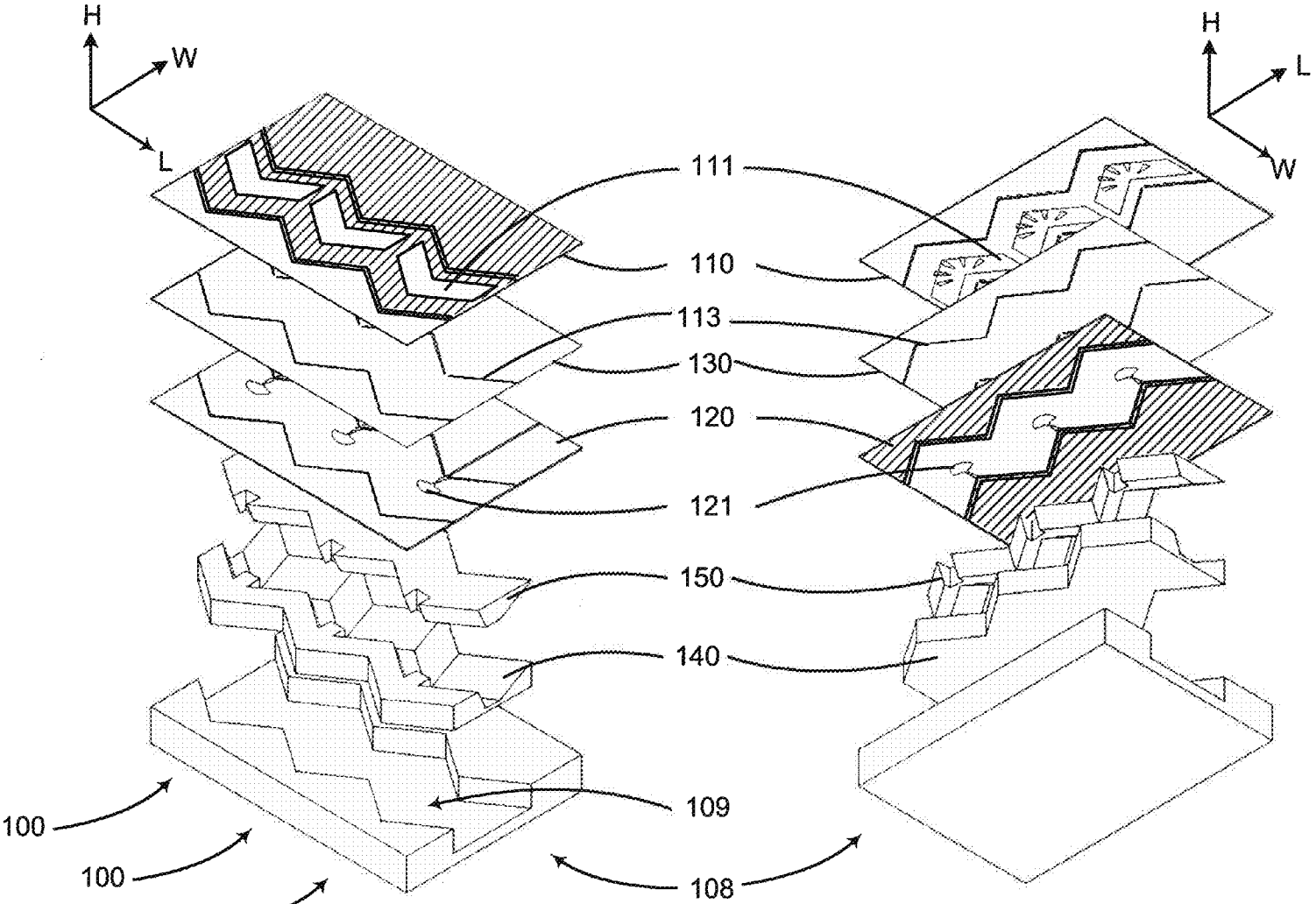
FIGS. 1A and 1B are two exploded perspective views of an array of cavity-backed slot antenna as viewed from above and below, respectively, according to one embodiment of the present invention.

In the following detailed description, only certain exemplary embodiments of the present invention are shown and described, by way of illustration. As those skilled in the art would recognize, the invention may be embodied in many different forms and should not be construed as being limited to the embodiments set forth herein. Also, in the context of the present application, when an element is referred to as being "on" another element, it can be directly on the other element or be indirectly on the other element with one or more intervening elements interposed therebetween. Like reference numerals designate like elements throughout the specification.

Embodiments of the present invention relate to a wideband (or "broadband") cavity-backed slot antenna including an angled slot and a plurality of coupled lines which are capacitively coupled to a balun. In some embodiments, the cavity-backed slot antenna may have a bandwidth ratio of 9:1 (in contrast with a typical cavity-backed slot antenna, which may have a bandwidth ratio of 3:1) and may be designed to operate in a frequency range of, for example, about 2 GHz to about 18 GHz, although the components may be scaled such that the antenna operates in a different frequency range.

A typical cavity-backed slot antenna includes a conductive surface having a slot that may be square or rectangular in shape. In contrast, some embodiments of the present invention include a conductive surface having a "V" or chevron shaped slot as shown, for example, in the slot 111 of FIGS. 1A and 1B. A cavity-backed slot antenna with a "V" or chevron shaped slot can operate over a substantially broader bandwidth than a similar slot antenna having a square or rectangular slot.

A typical antenna also includes a balun that couples the conductive portion of the antenna (the slot) and a stripline feed (the stripline feed connects the antenna to, for example, signal processing equipment). However, the performance of the balun varies with effective size and frequency, such that a smaller balun provides better performance at higher frequencies and a larger balun provides better performance at lower frequencies.

Figure 2:
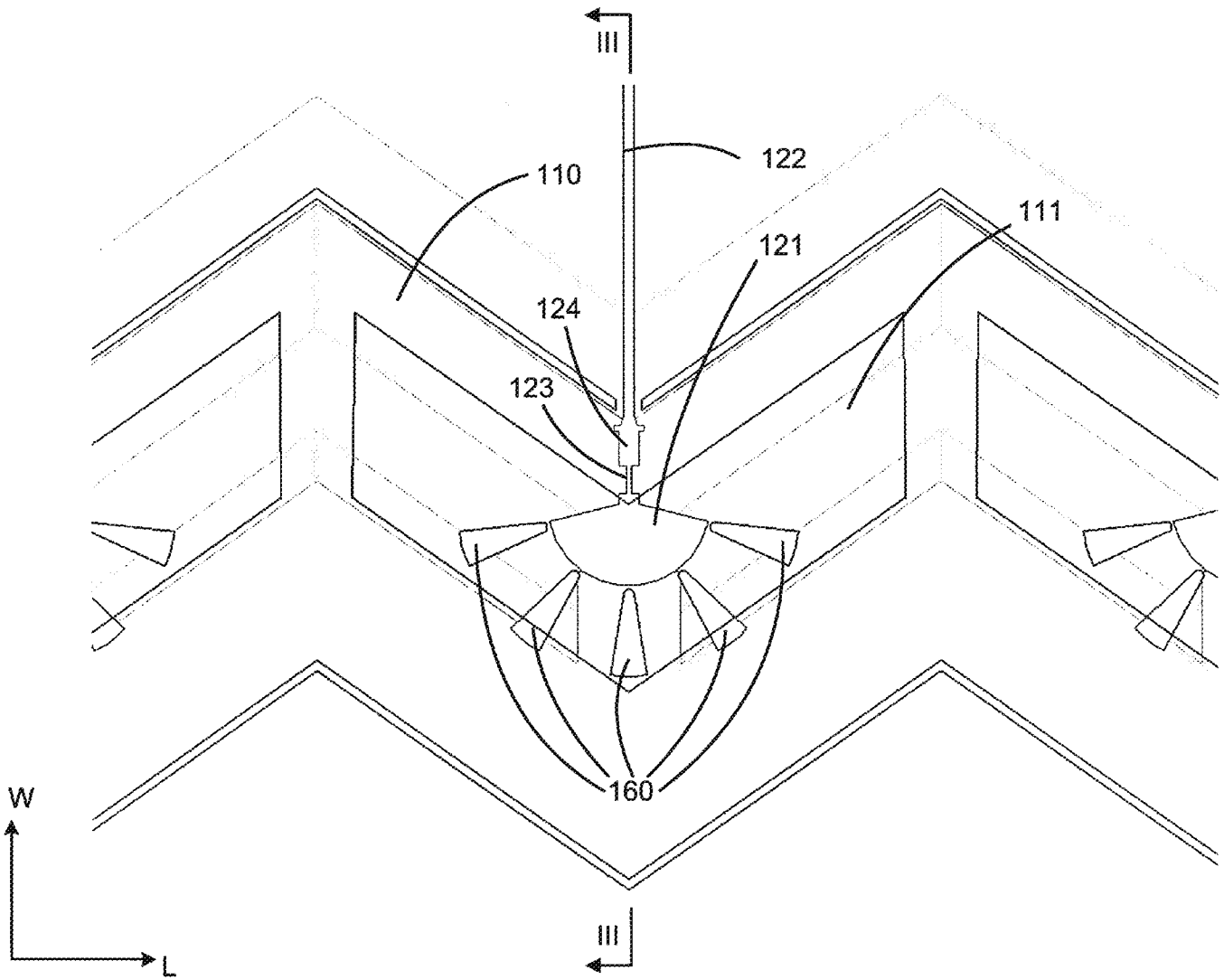
FIG. 2 is a plan view of the array of cavity-backed slot antennas of FIGS. 1A and 1B.

In some embodiments of the present invention, a plurality of coupled lines are capacitively coupled to and extend in a fan shape from the balun, as shown, for example, in the coupled lines 160 of FIG. 2. When lower frequency signals are applied to the balun, the capacitive coupling allows the signals to be applied to the coupled lines, which makes the balun appear larger at lower frequencies (i.e., the balun "appears" to include the coupled lines). When higher frequency signals are applied to the balun, the capacitive coupling blocks the signals from being applied to the coupled lines, which makes the balun appear smaller at high frequencies (i.e., the balun "appears" to not include the coupled lines). Therefore, a cavity-backed slot antenna according to one embodiment of the present invention provides a balun that achieves broadband performance by appearing larger at low frequencies and smaller at high frequencies.

Figure 3:
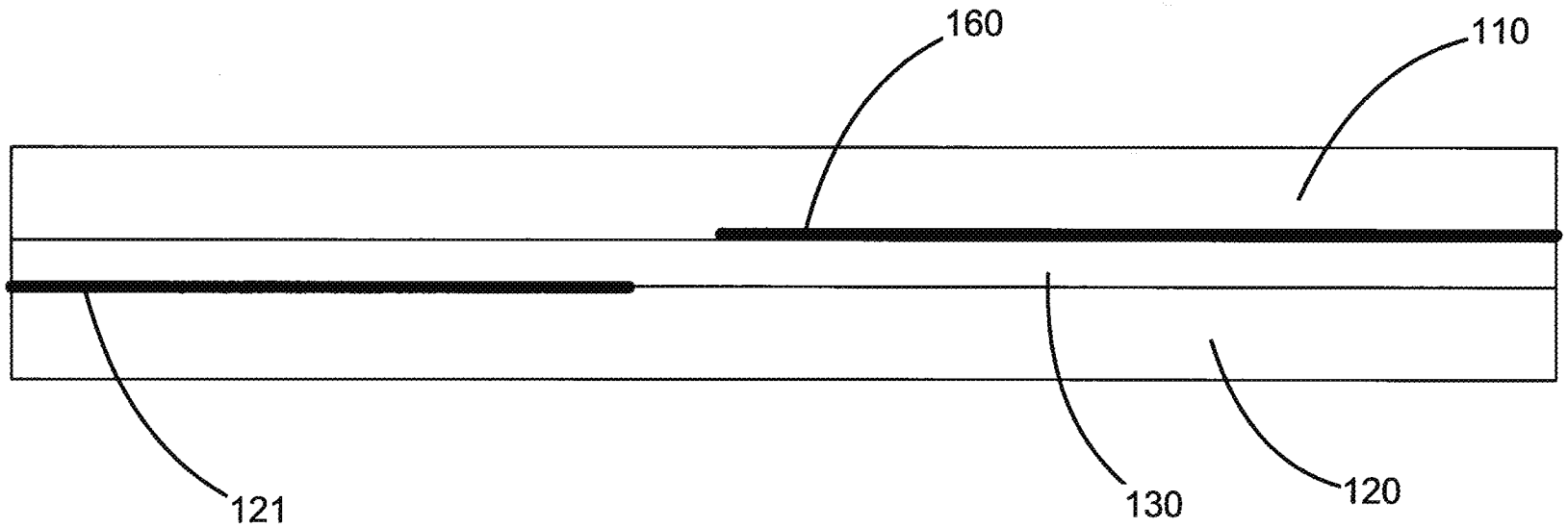
FIG. 3 is vertical cross-sectional view of an upper circuit card of the cavity-backed slot antenna of FIG. 2 along the line II-II.

FIGS. 1A and 1B are two exploded perspective views of an array of cavity-backed slot antenna taken from above and below, respectively, according to one embodiment of the present invention. FIG. 2 is a plan view of the array of cavity-backed slot antennas of FIGS. 1A and 1B. FIG. 3 is vertical cross-sectional view of an upper circuit card of the cavity-backed slot antenna of FIG. 2 taken along the line III-III.

Referring to FIGS. 1A and 1B, the cavity-backed slot antenna 100 includes a metal housing 108 having a cavity 109. The cavity may have a depth of about $\lambda_c/4$, where $\lambda_c$ is the wavelength of the center frequency (e.g., in an antenna designed to work in the 2 GHz to 18 GHz range, the center frequency is 10 GHz, in which case $\lambda_c/4$ would be about 0.3"). However, embodiments of the present invention are not limited to cavities having a depth of $\lambda_c/4$ and other cavity depths may also provide good broadband performance. For example, a cavity with a depth of $\lambda_l/4$ (where $\lambda_l$ is the wavelength of the lower cutoff frequency) may improve broadband performance (e.g., for an antenna designed to work in the 2 GHz to 18 GHz range, the lower cutoff frequency is 2 GHz, in which case $\lambda_l/4$ is about 1.48") but would also result in a larger antenna.

Still referring to FIGS. 1A and 1B, the cavity-backed slot antenna also includes an upper circuit card 110 which has a generally "V" or chevron shaped slot 111 located over the cavity 109. The cavity-backed slot antenna of FIGS. 1A and 1B also includes a lower circuit card 120 on which a balun 121 is formed. A bond film 130 attaches the lower circuit card 120 to the upper circuit card 110. The upper circuit card 110, the lower circuit card 120, the bond film 130, and the metal housing 108 together form an enclosure around the cavity 109. The upper and lower circuit cards may be made from Rogers 4003™, a glass reinforced hydrocarbon/ceramic laminate, or other suitable high frequency circuit board substrates. In the embodiment shown in FIGS. 1A and 1B, portions of the upper surface of the upper circuit card 110 and portions of the lower circuit card 120 may be metallized (or coated with metal) as indicated by the hashed areas shown in FIGS. 1A and 1B. In addition, the upper circuit card 110, the lower circuit card 120, and the bond film 130 include vias (e.g., vias 113 formed on the bond film) to isolate the cavity from electromagnetic radiation from the feed 122.

The cavity 109 in FIGS. 1A and 1B is partially filled with a dielectric material 140. The dielectric material 140 may be a magnetic radar absorbing material (magram) such as iron ball paint, urethane foam loaded with iron, or equivalents well known in the art. The dielectric may be placed along the bottom surface of the cavity, at front and back end caps, along the sidewalls, fill the middle of the cavity, or any combination of these locations as shown, e.g., in FIGS. 5A, 5C, 5D, and 5E. In addition, the magram can also be located underneath one of the coupled lines 160.

A space between the dielectric material 140 and the lower circuit card 120 may be filled with air or a low dielectric filler material 150 such as AIREX® foam. The filler material 150 may be substantially transparent to electromagnetic waves.

In the embodiment of FIGS. 1A and 1B, the cavity may have a width of 1.1" (along the line W-W) and a length of 1.2" (along the line L-L) and the slot may have a length of 1.08" and a width of 0.36". The slot has a chevron shape with an angle of 120° at its tip, but in other embodiments, the slot may have different angles. In addition, the cavity in FIGS. 1A and 1B has a zigzag shape and an angle of 120° at its points (i.e., the cavity of one antenna 100 has a chevron shape with an angle of 120° at its point, and therefore a cavity of an array of antennas 100 placed side by side has a zigzag shape). However, embodiments of the present invention are not limited to these dimensions. According to some embodiments of the present invention, a wider or longer cavity may increase the bandwidth of the slot antenna. Similarly, a longer slot may improve performance at lower frequencies and/or shift the operating bandwidth to a lower frequency range. In addition, a person of ordinary skill in the art would readily understand that scaling the dimensions of the antenna would change the operating frequency range of the antenna in predictable ways. For example, doubling each of the dimensions of the antenna (while making some minor tuning adjustments) would result in an antenna which operated between 1 GHz and 9 GHz.

Referring to FIG. 2, an antenna according to one embodiment of the present invention includes a balun 121. The balun 121 depicted in FIG. 2 is fan-shaped, but in other embodiments may have other suitable shapes. The angle and length of the fan-shaped balun affect the bandwidth of the coupling between the balun and the slot. In the exemplary embodiment shown in FIG. 2, the angle of the balun is approximately 156° to maximize the bandwidth of the coupling, but in other embodiments the balun may have a different angle.

In the cavity-backed slot antenna of FIGS. 1, 2, and 3, a balun 121 and a stripline feed 122 coupled to the balun 121 are formed on an upper surface of the lower circuit card 120. The balun 121 may be placed near coupled lines 160 formed on a lower surface of the upper circuit card 110. In other embodiments, the balun 121 and the stripline feed 122 may be formed on the upper circuit card 110 while the coupled lines 160 are formed on the lower circuit card 120. The balun 121 may be coupled to the stripline feed 122 via an inductor 123 and/or a capacitor 124 in series in order to improve the load match between the stripline feed 122, the balun 121, and the antenna 100.

Referring to FIGS. 2 and 3, coupled lines 160 may be located proximate but not in direct contact with the balun. For example, as shown in FIG. 3, the balun 121 and a coupled line 160 may be formed on the first and second circuit cards 110 and 120, respectively, and separated by a bond film 130. When the balun 121 is driven at low frequencies, the coupled lines 160 are electrically coupled to the balun 121 such that the coupled lines 160 make the balun 121 appear larger, thereby improving performance at low frequencies. When the balun 121 is driven at high frequencies, the coupled lines 160 are substantially electrically decoupled from the balun 121, thereby making the balun appear smaller and improving performance at high frequencies. Therefore, the coupled lines 160 increase the bandwidth of the cavity backed slot antenna.

Figure 4:
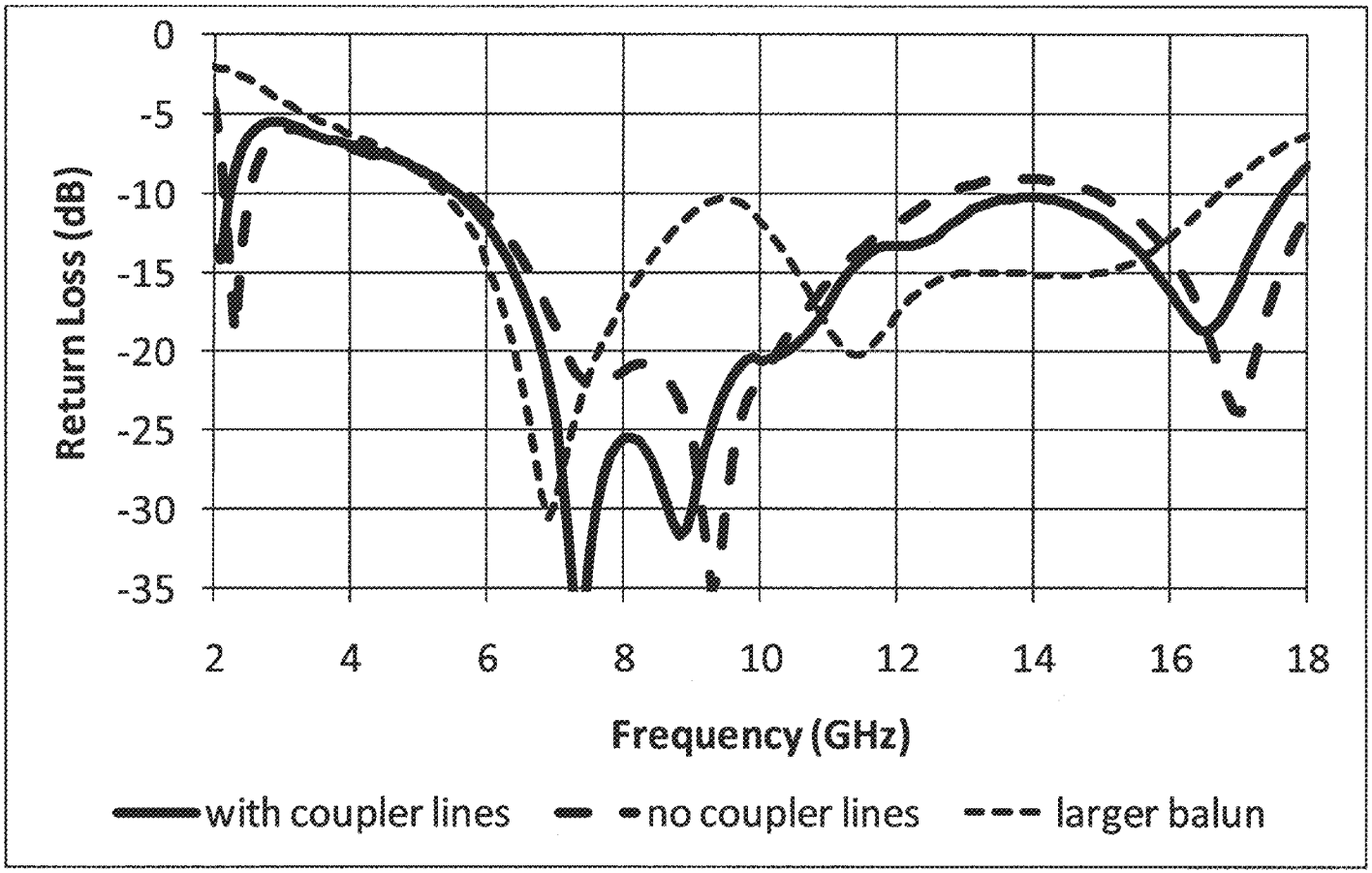
FIG. 4 is a graph comparing the return loss between 2 GHz and 18 GHz for a balun according to the embodiment of FIG. 2 against a larger balun and a balun the same size, both without the coupled lines.

FIG. 4 is a graph which illustrates the effect of the coupled lines by comparing the return loss performance of an antenna with a balun 121 and coupled lines 160 in accordance with the exemplary embodiment shown in FIG. 2 against two baluns without coupled lines: one being a larger balun (the apparent size of the balun of FIG. 2 with the coupled lines in a coupled state) and the other being the same size as that the balun 121 of FIG. 2. As can be seen in FIG. 4, a balun without the coupled lines has weaker low frequency performance, such that the balun only performs adequately between about 6 GHz and about 18 GHz (for a bandwidth ratio of 3:1). On the other hand, the larger balun has a low end cutoff frequency of 3 GHz (and also has weaker performance between about 17 GHz and 18 GHz), and therefore also has a smaller bandwidth than the balun of the embodiment of FIG. 2.

The distance and the amount of overlap between the balun 121 and the coupled lines 160 contribute to determining a transition frequency at which capacitive coupling between the balun 121 and the coupled lines 160 begins to have a substantial effect. Therefore, one of ordinary skill in the art would adjust, for example, the thickness of the bond film 130 or the amount of overlap in the plane of the upper and lower circuit cards 110 and 120 in order to set an optimal transition frequency based on the desired operating frequency range of the antenna.

In the embodiment of FIG. 2, there are five coupled lines 160. Other embodiments of the present invention may include different numbers of coupled lines in other suitable arrangements. An appropriate number and spacing of the coupled lines may be determined by a person of ordinary skill in the art based on the frequency range at which embodiments of the present invention may be designed to operate. For example, the coupled lines may be spaced discretely to reduce the amount of coupling at high frequencies. Similarly, the coupled lines 160 shown in FIG. 2 have a wedge shape, but the coupled lines may have rectangular or other suitable shapes.

Figure 5C:
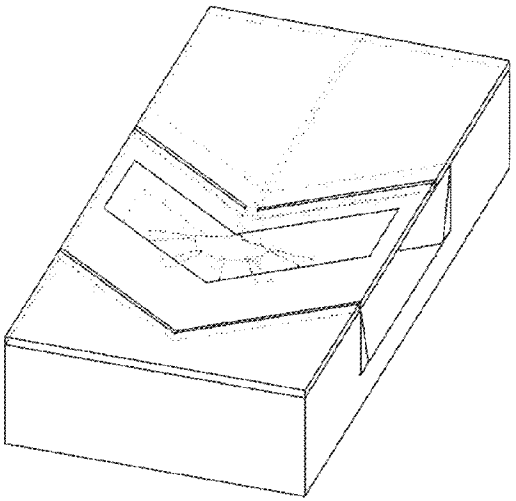
FIGS. 5A, 5B, 5C, 5D, and 5E are perspective views of embodiments of the present invention in which different portions of the cavity are partially filled with dielectric such as a magnetic radar absorbing material.
Figure 5B:
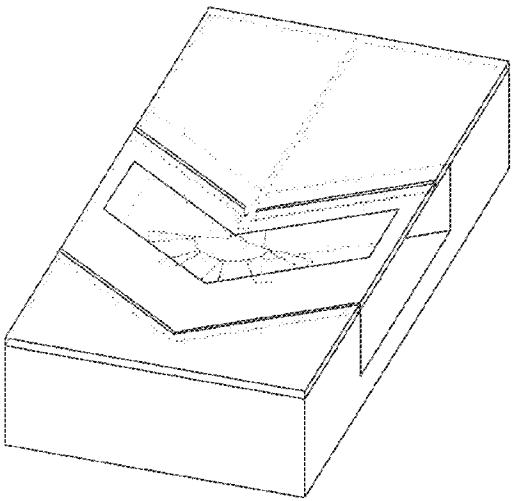
Figure 5A:
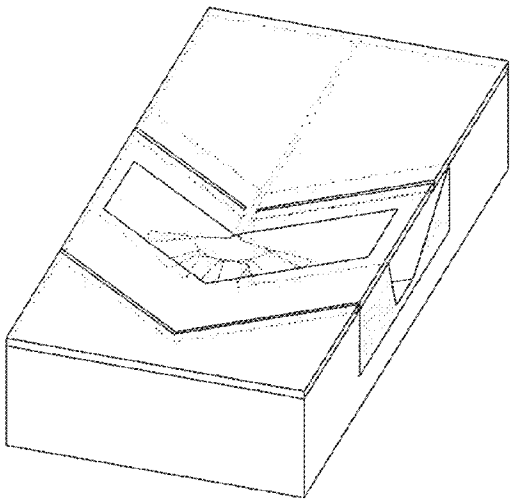
Figure 5E:
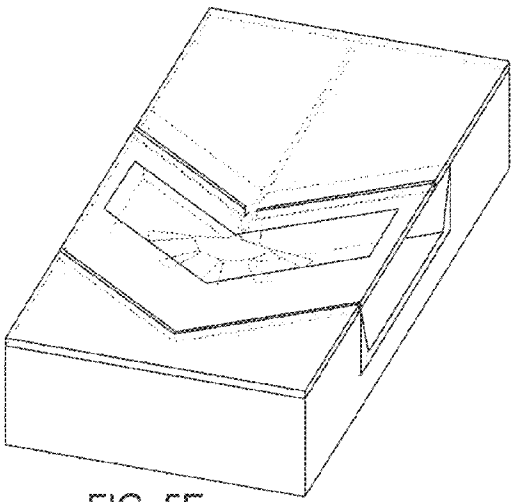
Figure 5D:
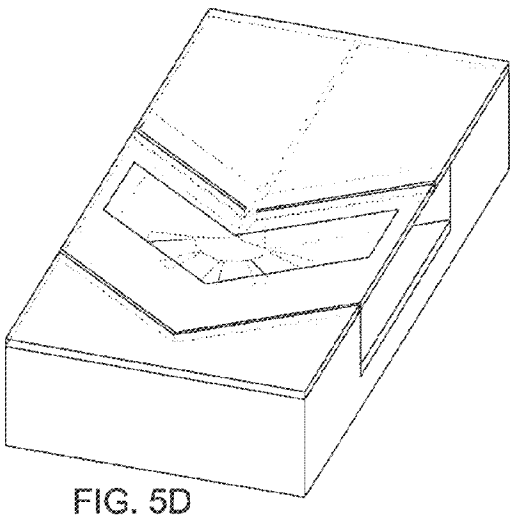
Figure 6:
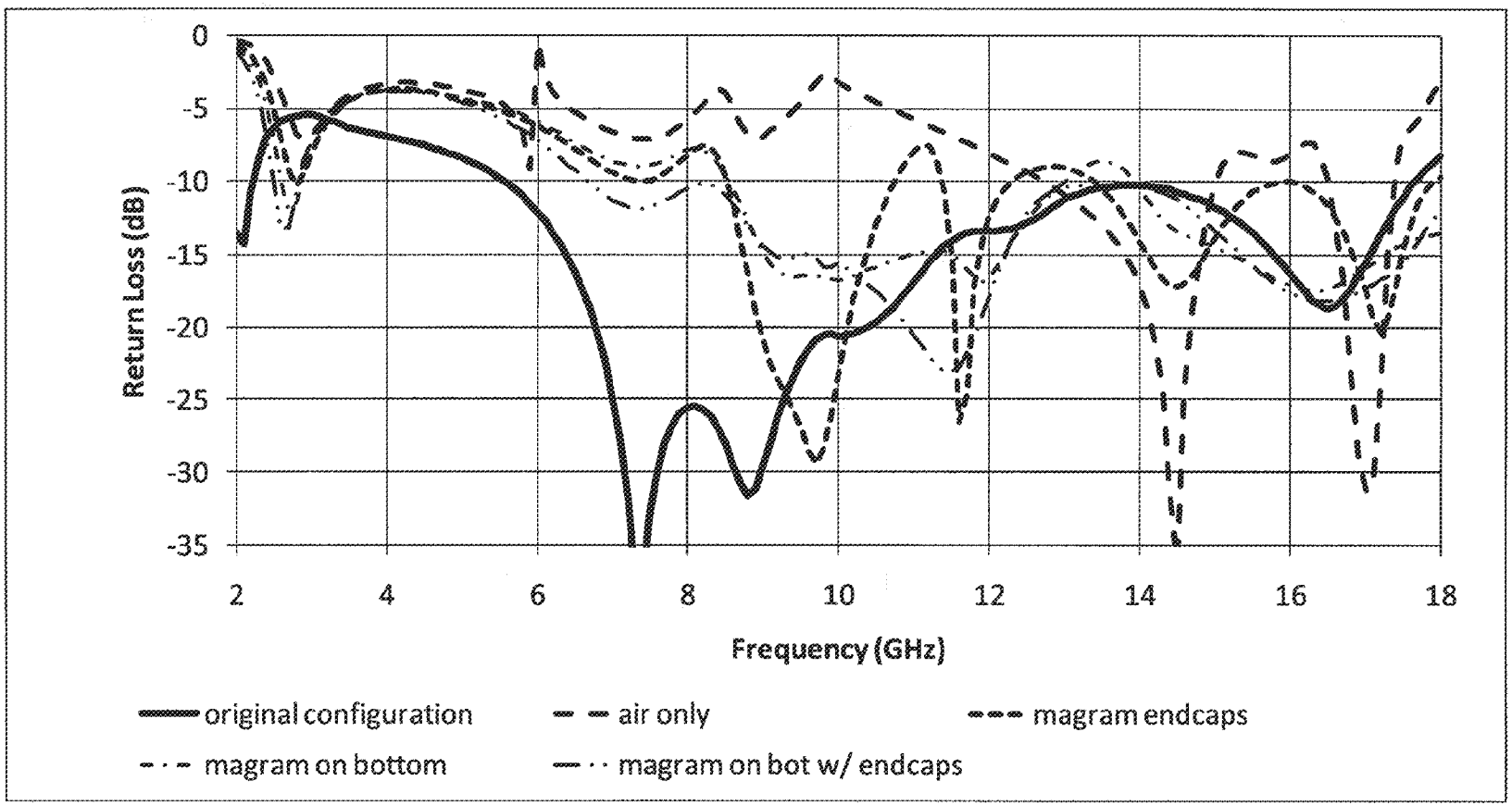
FIG. 6 is a graph comparing simulated return losses of the embodiments depicted in FIGS. 5A, 5B, 5C, 5D, and 5E.

FIG. 5A shows a cavity backed slot antenna with magram arranged in the cavity as shown in the embodiment of FIGS. 1A and 1B. FIGS. 5B, 5C, 5D, and 5E show cavity backed slot antennas without magram (e.g., with the cavity filled with air), with magram only at front and back end caps of the cavity, with magram only on the bottom of the cavity, and with magram on both the bottom and end caps of the cavity, respectively. FIG. 6 is a graph comparing loss return performance for the embodiments shown in FIGS. 5A, 5B, 5C, 5D, and 5E. Placing magram into the cavity appears to increase the bandwidth by preventing resonances from developing at lower frequencies. As can be seen in FIG. 6, a larger amount of magram generally appears to widen the bandwidth. In addition, a magram block directly beneath a coupled line of the coupled lines 160 (such as the magram block located under the center coupled line in FIG. 5A) also appears to help to widen the bandwidth at the lower end of the frequency bandwidth.

Figure 7A:
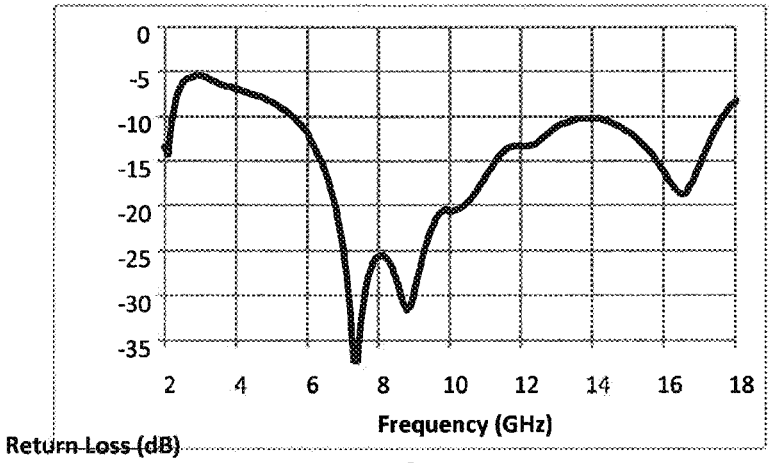
FIGS. 7A, 7B, and 7C are graphs of simulated results of return loss, average gain, and efficiency of a cavity-backed slot antenna between 2 GHz and 18 GHz according to one embodiment of the present invention.
Figure 7B:
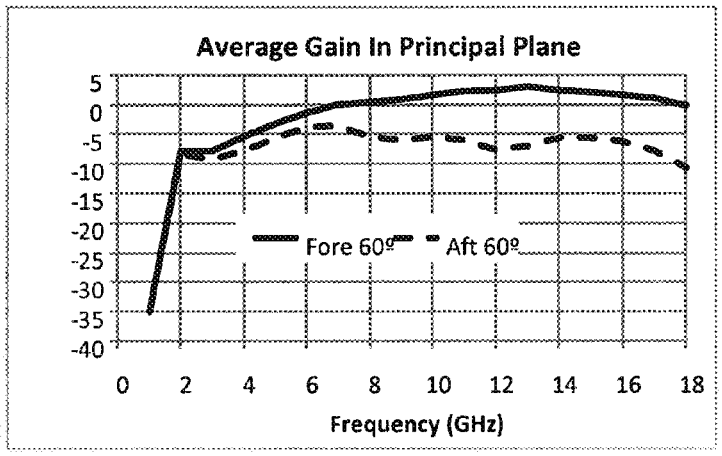
Figure 7C:
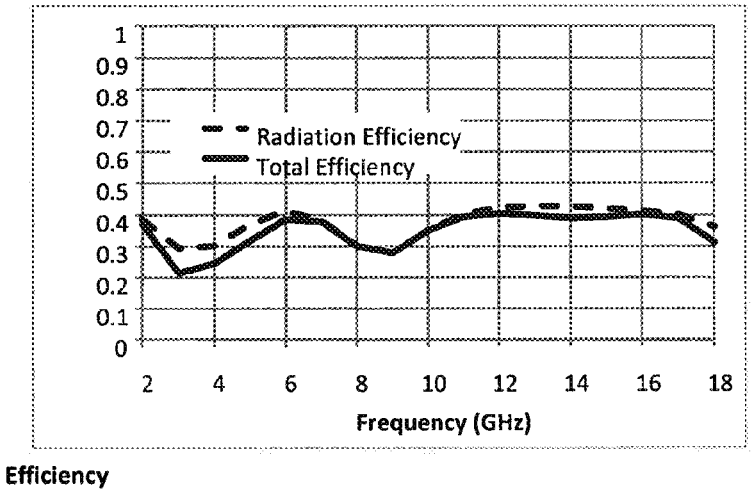

FIGS. 7A, 7B, and 7C are graphs of simulated results of return loss, average gain, and efficiency of a cavity-backed slot antenna between 2 GHz and 18 GHz, according to the exemplary embodiment shown in FIGS. 1A and 1B.

Figure 8C:
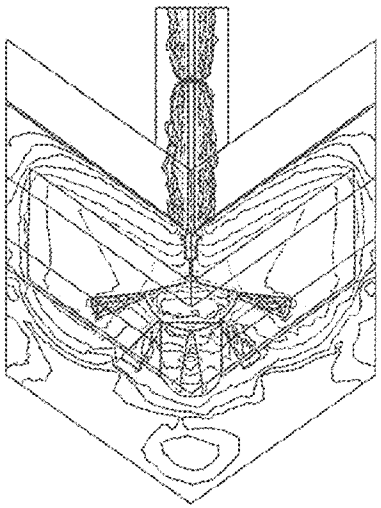
FIGS. 8A, 8B, 8C, 8D, and 8E depict equipotential lines of simulated electric field strengths of a cavity-backed slot antenna according to one embodiment of the present invention at 2 GHz, 3 GHz, 6 GHz, 10 GHz, and 18 GHz, respectively.
Figure 8B:
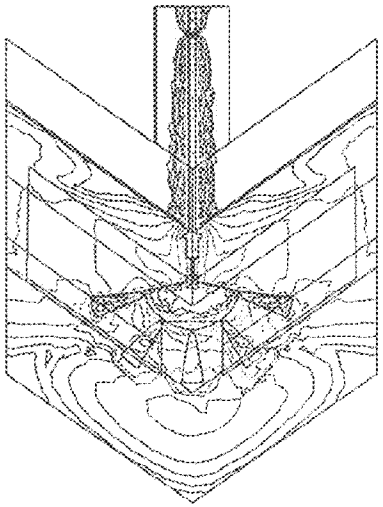
Figure 8A:
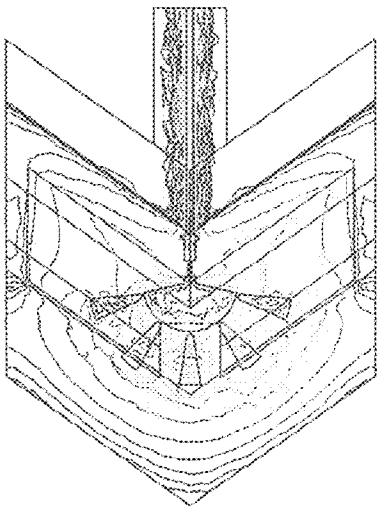
Figure 8E:
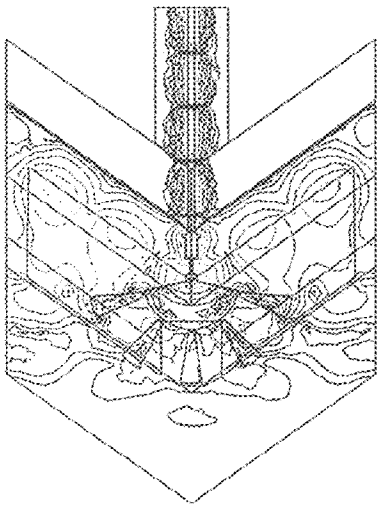
Figure 8D:
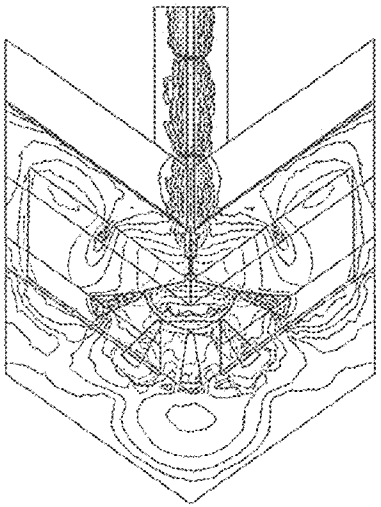

FIGS. 8A, 8B, 8C, 8D, and 8E are simulated contour plots showing equipotential lines of electric fields of the cavity-backed slot antenna of FIGS. 1 and 2 at 2 GHz, 3 GHz, 6 GHz, 10 GHz, and 18 GHz, respectively. As can be seen in the plots, the fields move farther forward on the fan-shaped balun as the frequency decreases and the coupled lines increase the size of the balun at 2 GHz (FIG. 8A).

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

For example, the metal housing may be formed as part of an exterior wall of a structure or a vehicle. As another example, although the figures depict the array of cavity-backed slot antennas as extending in one direction, arrays of cavity backed slot antennas may extend in two directions (e.g., they may be arranged into rows and columns). The figures also depict the cavities of adjacent cavity-backed slot antennas as being merged into one cavity, but in some embodiments, metal walls may separate the cavities of adjacent cavity-backed slot antennas.

What is claimed is:

1. A cavity-backed slot antenna comprising:
an enclosure having a slot;
a balun located proximate the slot;
a feed extending through the enclosure and electrically coupled to the balun at a first location; and
a plurality of coupled lines proximate the balun and distal to the first, the plurality of coupled lines being configured to be capacitively coupled to the balun when a low frequency signal is applied to the feed.

2. The cavity-backed slot antenna of claim 1, wherein the balun is fan shaped.

3. The cavity-backed slot antenna of claim 1, wherein the plurality of coupled lines is configured to be decoupled from the balun when a high frequency signal is applied to the feed.

4. The cavity-backed slot antenna of claim 1, wherein the slot has a chevron shape.

5. The cavity-backed slot antenna of claim 4, wherein the slot has an angle of 120° at a tip of the slot.

6. The cavity-backed slot antenna of claim 1, wherein the enclosure encloses a cavity having a chevron shape.

7. The cavity-backed slot antenna of claim 6, wherein the cavity has an angle of 120° at a tip of the enclosure.

8. The cavity-backed slot antenna of claim 1 further comprising a dielectric material located within the enclosure.

9. The cavity-backed slot antenna of claim 1, wherein the dielectric material is magnetic radar absorbing material.

10. The cavity-backed slot antenna of claim 1, further comprising a capacitor and an inductor coupled in series between the feed and the balun.

11. A cavity-backed slot antenna comprising:
an enclosure having a chevron-shaped slot;
a balun located proximate the slot; and
a feed extending through the enclosure to the balun,
wherein the enclosure encloses a cavity having a chevron shape.

12. The cavity-backed slot antenna of claim 11, wherein the cavity has an angle of 30° at a tip of the enclosure.

13. The cavity-backed slot antenna of claim 11, wherein the slot has an angle of 30° at a tip of the slot.

14. The cavity-backed slot antenna of claim 11, wherein the cavity-backed slot antenna is a wideband antenna.

15. An antenna array comprising:
a plurality of cavity-backed slot antennas, each of the cavity backed slot antennas comprising:
an enclosure having a slot;
a balun located proximate the slot;
a feed extending through the enclosure and electrically coupled to the balun at a first location; and
a plurality of coupled lines proximate the balun and distal to the first location, the plurality of coupled lines being configured to be capacitively coupled to the balun when a low frequency signal is applied to the feed, wherein the cavity backed slot antennas are adjacent to one another.

16. The antenna array of claim 15, wherein the slot of each of the cavity-backed slot antennas is chevron-shaped.

17. An antenna array comprising:

a plurality of cavity-backed slot antennas, each of the cavity backed slot antennas comprising:

an enclosure having a chevron-shaped slot, wherein the enclosure encloses a cavity having a chevron shape;

a balun located proximate the slot; and a feed extending through the enclosure to the balun, wherein the cavity backed slot antennas are adjacent to one another.

* * * * *